US005898404A

United States Patent [19]

Jou

[11] Patent Number: 5,898,404

[45] Date of Patent: Apr. 27, 1999

[54] NON-COPLANAR RESONANT ELEMENT PRINTED CIRCUIT BOARD ANTENNA

[75] Inventor: Chewnpu Jou, Hsinchu, Taiwan

[73] Assignee: Industrial Technology Research Institute, Hsinchu, Taiwan

[21] Appl. No.: 08/578,881

[22] Filed: Dec. 22, 1995

[51] Int. Cl.[6] ..... H01Q 1/38; H01Q 1/52

[52] U.S. Cl. ..... 343/700 MS; 343/702; 343/841

[58] Field of Search ..... 343/700 MS, 702, 343/846, 848, 841; H01Q 1/38, 1/52

[56] References Cited

U.S. PATENT DOCUMENTS

| | | | |
|---|---|---|---|
| 4,401,988 | 8/1983 | Kaloi | 343/700 MS |
| 4,791,423 | 12/1988 | Yokoyama et al. | 343/700 MS |
| 4,907,006 | 3/1990 | Nishikawa et al. | 343/700 MS |
| 4,965,605 | 10/1990 | Chang et al. | 343/700 MS |
| 5,309,164 | 5/1994 | Dienes et al. | 343/700 MS |

OTHER PUBLICATIONS

J. Rasinger, et al., *A New Enhanced-Bandwidth Internal Antenna for Portable Communications*, 40th IEEE Vehicular Tech. Conf., 1990.

I.G. Choi, et al., *UHF Tapered Bent-Slot Antenna for Small Sized Portable Phones*, 42ND IEEE Vehicular Tech. Conf., pp. 9–12, (1992).

E. Onegreau, *EEsof User's Group Meeting*, Sonnet EM User's Manual, ver. 2.4, p. 85, 1993.

*Primary Examiner*—Hoanganh T. Le

*Attorney, Agent, or Firm*—Meltzer, Lippe, Goldstein, Wolf & Schlissel, P.C.

[57] ABSTRACT

An antenna is provided including first and second strip resonant elements, a dielectric and a metal cover. The first strip resonant element has an F-shaped area that lies in a first plane. The second strip resonant element has an L-shaped area that lies in a second plane that is parallel to the first plane. The second strip at least partially underlies the first strip. The dielectric is positioned between the first and second strips. A metal cover is provided. Part of the metal cover is positioned perpendicularly to the first and second strips so as to provide electromagnetic shielding for the first and second strips.

13 Claims, 9 Drawing Sheets

NON-COPLANAR RESONANT ELEMENT PRINTED CIRCUIT BOARD ANTENNA

FIELD OF THE INVENTION

The present invention relates to antennas designed for use in, for example, cellular telephones in the GHz frequency range.

BACKGROUND OF THE INVENTION

The current trend in miniaturizing and reducing the manufacturing costs of personal portable communication equipment, such as cellular telephones, has prompted engineers to study the design of the antennas within the portable communications equipment. See J. Rasinger, et al., *A New Enhanced-Bandwidth Internal Antenna for Portable Communications*, $40^{TH}$ IEEE VEHICULAR TECH. CONF., 1990; I. G. Choi, et al., *UHF Tapered Bent-Slot Antenna for Small Sized Portable Phones*, $42^{ND}$ IEEE VEHICULAR TECH. CONF., P. 9–12, (1992); X. Z. Li, et al., *Research Report on* 1.8 *GHz Foldable Hand-Machine Antenna*; E. Onegreau, *EEsof User's Group Meeting*, SONNET EM USER'S MANUAL, ver. 2.4, p. 85, 1993; U.S. Pat. No. 4,401,988; U.S. Pat. No. 4,965,605. Some conventional antenna designs which have been commercialized include short wire antennas, small loop antennas and normal mode helical antennas.

Perhaps the greatest challenge to miniaturizing the antennas is maintenance of the frequency bandwidth of the antenna. Generally speaking, bandwidth narrowing renders the communication more susceptible to degradation as a result of changes in the environment. Aside from performance issues, it is also desirable to reduce the cost of manufacturing the antenna, and to reduce the complexity of antenna manufacture.

FIG. 1 shows a first conventional antenna 10 referred to as a "plane" dual-L antenna taught by X. Z. Li, et al., *Research Report on* 1.8 *GHz Foldable Hand-Machine Antenna*. As shown, the antenna includes a ground plane 12, and two L-cross sectioned resonant units 14 and 16 connected to the ground plane 12. The bandwidth is adjusted by the coupling across the opening between the two resonant units 14 and 16. The field patterns for the antenna 10 are illustrated in FIGS. 2, 3 and 4. FIG. 5 shows the variation of the reflection coefficient $s_{11}$ of the antenna 10 in relation to frequency. As shown, the antenna 10 has a large bandwidth.

The antenna 10 is referred to as a "plane" antenna because the conductors of the resonant units 14,16 are in the same planes; the portions 14*a* and 16*a* are in the same plane and the portions 14*b* and 16*b* are in the same plane. The dimensions of the antenna 10 are as follows: L1=2.8 cm, w1=0.45 cm, L2=5.27 cm, w2=0.45 cm, h34=0.5 cm, w34=0.45 cm, h5=0.5, L6=4.0 cm, w6=1.0 cm, s1=s2=0.1 cm. A problem with the antenna 10 is that it takes up a large amount of volume (i.e., 5.27 $cm^3$) and a large area (i.e., 2.8 $cm^2$). In addition, the antenna 10 must be constructed using a special metal work processing that cannot be done automatically, i.e., must be done manually. Furthermore, the antenna 10 requires a special copper on aluminum alloy coating to render the antenna vibration proof.

FIG. 6 illustrates a second antenna 20 referred to as a "coupled microstrip patch antenna." The coupled microstrip patch antenna 20 includes plural, e.g., three, resonator patches 22, 24 and 26 which are all located in the same plane. Illustratively, the antenna shown in FIG. 6 is designed for 2.4 GHz. FIG. 7 illustrates the variation of the reflection coefficient in relation to frequency. As shown, the bandwidth of the antenna 20 is limited to about 1%. Nevertheless, such a narrow bandwidth is useful for beam antennas, e.g., in radar arrays.

FIG. 8 illustrates a multi-layered microstrip patch antenna 30 disclosed in U.S. Pat. No. 4,401,988. A feed pin 31, of a coaxial cable 32 is connected to a radiating element patch 33. The radiating element patch 33 is affixed to a dielectric substrate 34 which separates the radiating element patch 33 from a parasitic element 35. The parasitic element 35 is affixed to another dielectric 36 which separates the parasitic element 35 from a ground plane layer 37. The coupling effect between the radiating element patch 33 and the parasitic element 35 enhances the radiation at angles closer to the ground plane. Compare FIG. 10, which shows a field pattern for the single layer microstrip patch antenna 20 of FIG. 6, to FIG. 9, which shows a field pattern for the multi-layered microstrip patch antenna 30 of FIG. 8. Note the field pattern as the elevation increases from ground level beyond 45°. The maximum field value occurs at 90° from ground level, i.e., at right angles to the patches. When the coupled microstrip patch antenna 20 is arrayed, the beam is typically even narrower.

The problem with the coupled microstrip patch antenna is the extremely large area which it occupies, i.e., on the order of 30 $cm^2$. In addition, the coupled microstrip patch antenna produces a highly directional beam. In small portable communications devices, it is desirable for an antenna to achieve the contrary effect—to produce an omni-directional field pattern. This ensures good reception regardless of how the antenna is oriented in regard to the other transceiver. Furthermore, the coupled microstrip patch antenna must be assembled manually.

It is an object of the present invention to overcome the disadvantages of the prior art.

SUMMARY OF THE INVENTION

This and other objects are achieved by the present invention. According to one embodiment, an antenna is provided including first and second strip resonant elements, a dielectric and a metal cover. The first strip resonant element has an F-shaped area that lies in a first plane. The second strip resonant element has an L-shaped area that lies in a second plane that is parallel to the first plane. The second strip at least partially underlies the first strip. The dielectric is positioned between the first and second strips. The metal cover has a portion which is positioned perpendicularly to the first and second strips so as to provide electromagnetic shielding for the first and second strips. That is, the metal cover prevents signals emitted on one side of the perpendicular portion (by, for instance, the circuitry of the portable transceiver) from propagating to, and being received by, the firsthand second strips on the other side of the perpendicular portion. Likewise, the metal cover prevents signals emitted by the first and second strips from propagating to the other side of the perpendicular portion of the metal cover.

Illustratively, the metal cover includes first and second L-bracket shaped portions. The first L-bracket shaped portion is perpendicularly connected to the first strip and the second L-bracket shaped portion is perpendicularly connected to the second strip so that the first and second L-bracket shaped portion overlap each other but do not overlap the second strip.

The antenna may be produced using ordinary fiberglass printed circuit board (PCB) manufacturing processes. For instance, the first and second strips may simply be conductor strips that are laid out on a fiberglass printed circuit board which serves as the dielectric.

In short, an antenna is provided which is durable, inexpensive, easy to manufacture by automated processes and which has a very good field coverage in all directions.

DETAILED DESCRIPTION OF THE INVENTION

Figure 1:
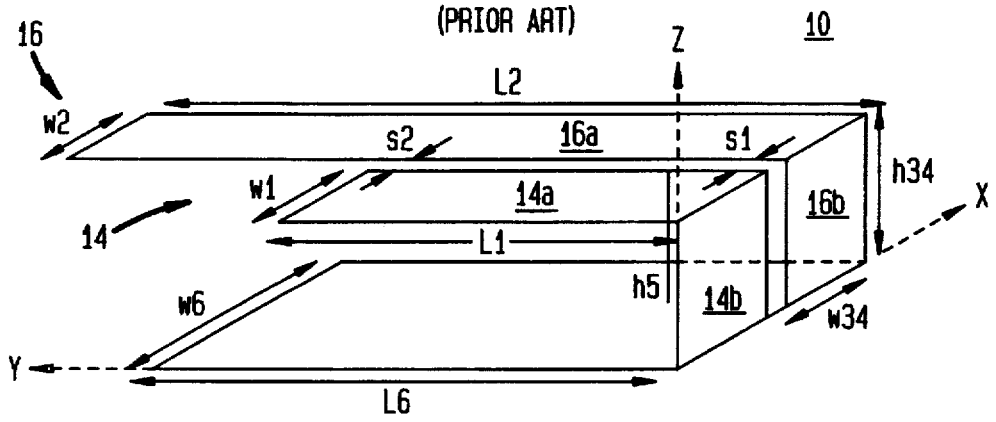
FIG. 1 (PRIOR ART)
FIG. 1 shows a conventional dual-L antenna.
Figure 5:
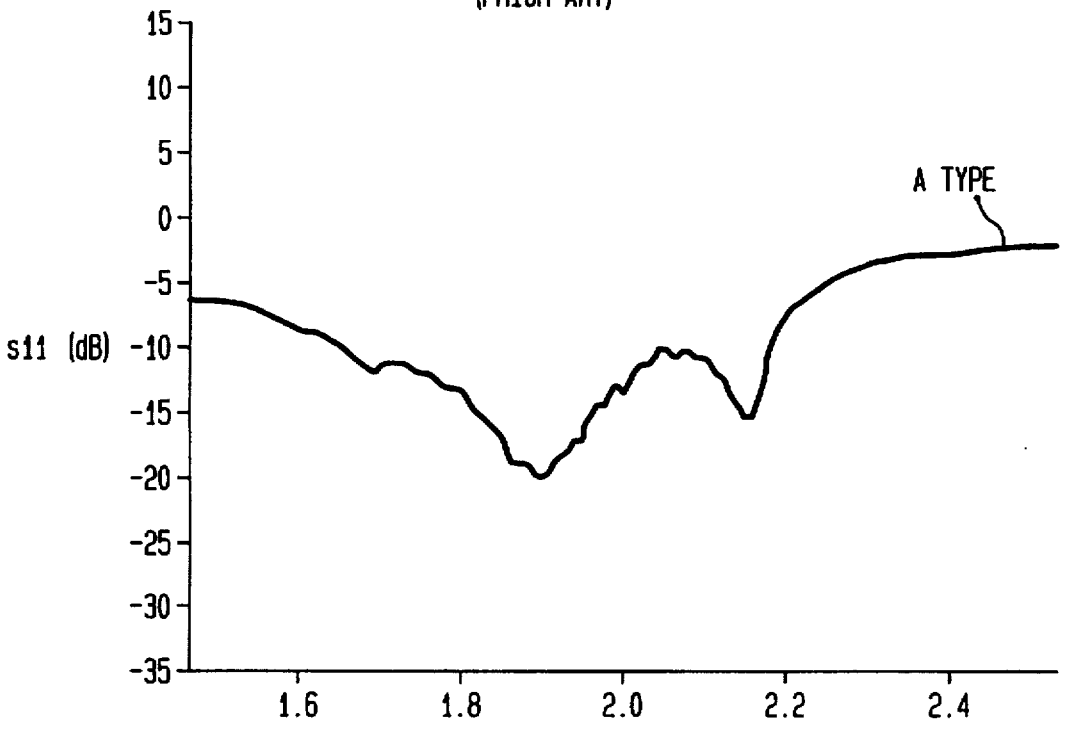
FIG. 5 (PRIOR ART)
FIG. 5 shows the variation of reflection coefficient $S_{11}$ of the antenna of FIG. 1 with frequency.
Figure 6:
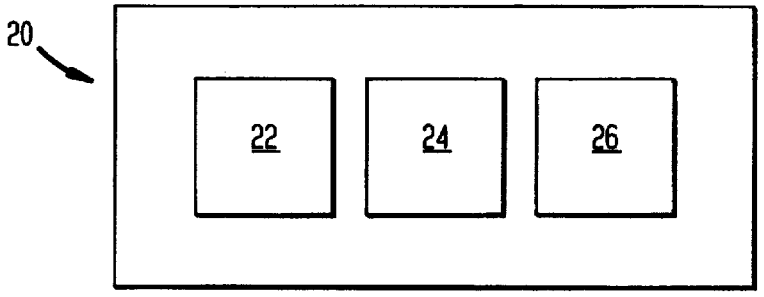
FIG. 6 (PRIOR ART)
FIG. 6 shows a conventional coupled microstrip patch antenna.
Figure 2:
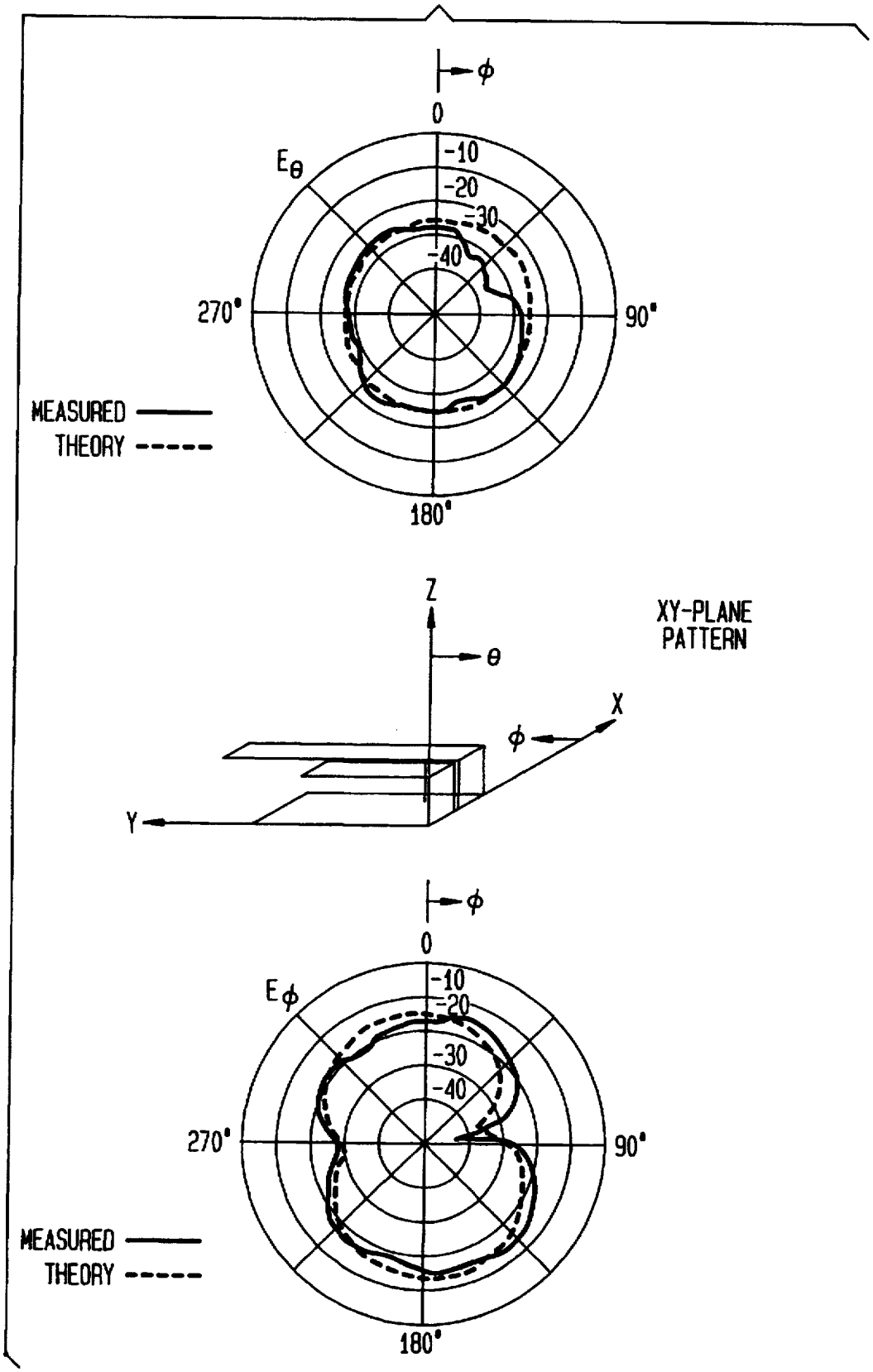
FIG. 2 (PRIOR ART)
FIG. 2 shows an XY plane field pattern of the antenna of FIG. 1.
Figure 3:
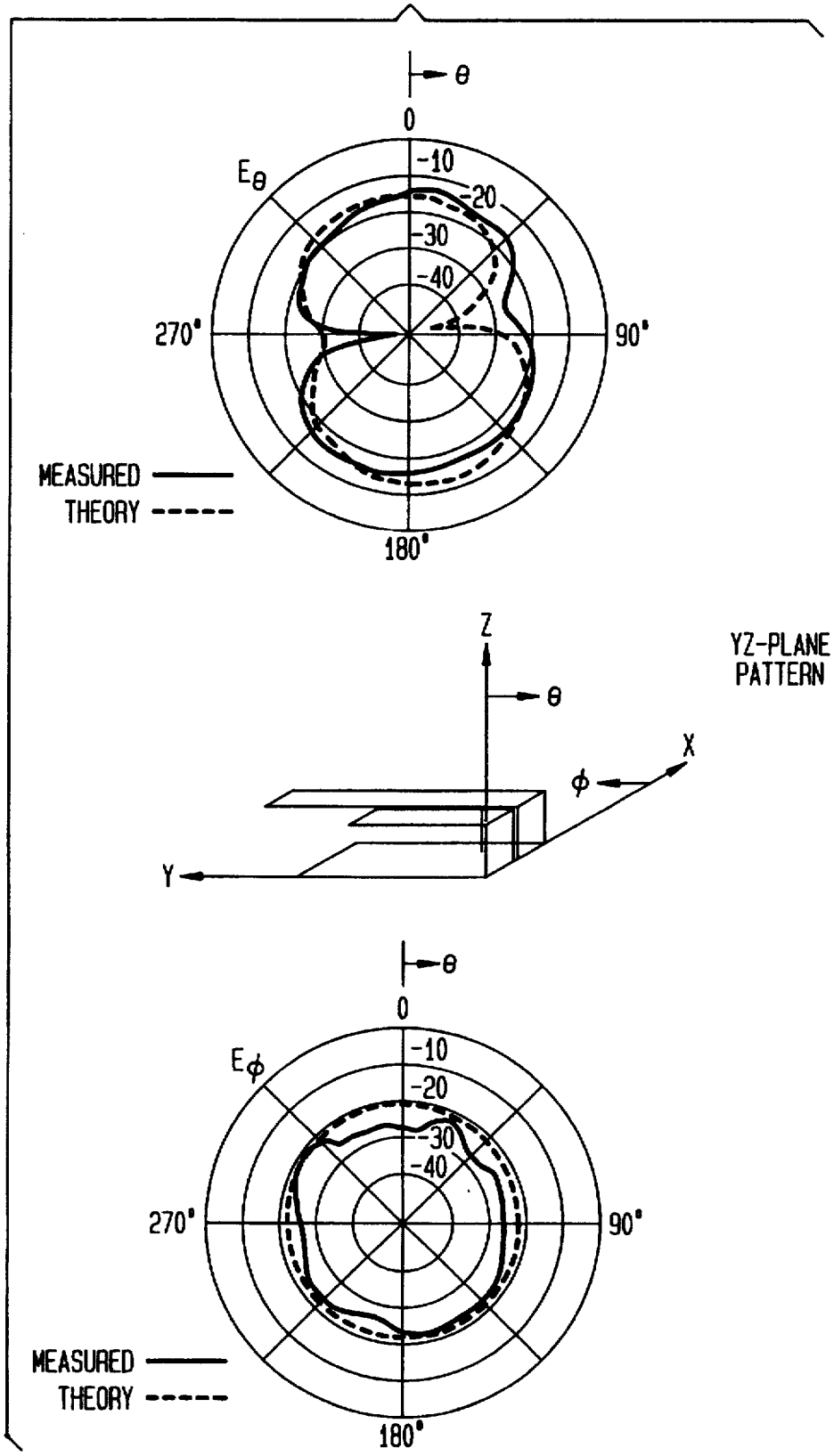
FIG. 3 (PRIOR ART)
FIG. 3 shows a YZ plane field pattern of the antenna of FIG. 1.
Figure 4:
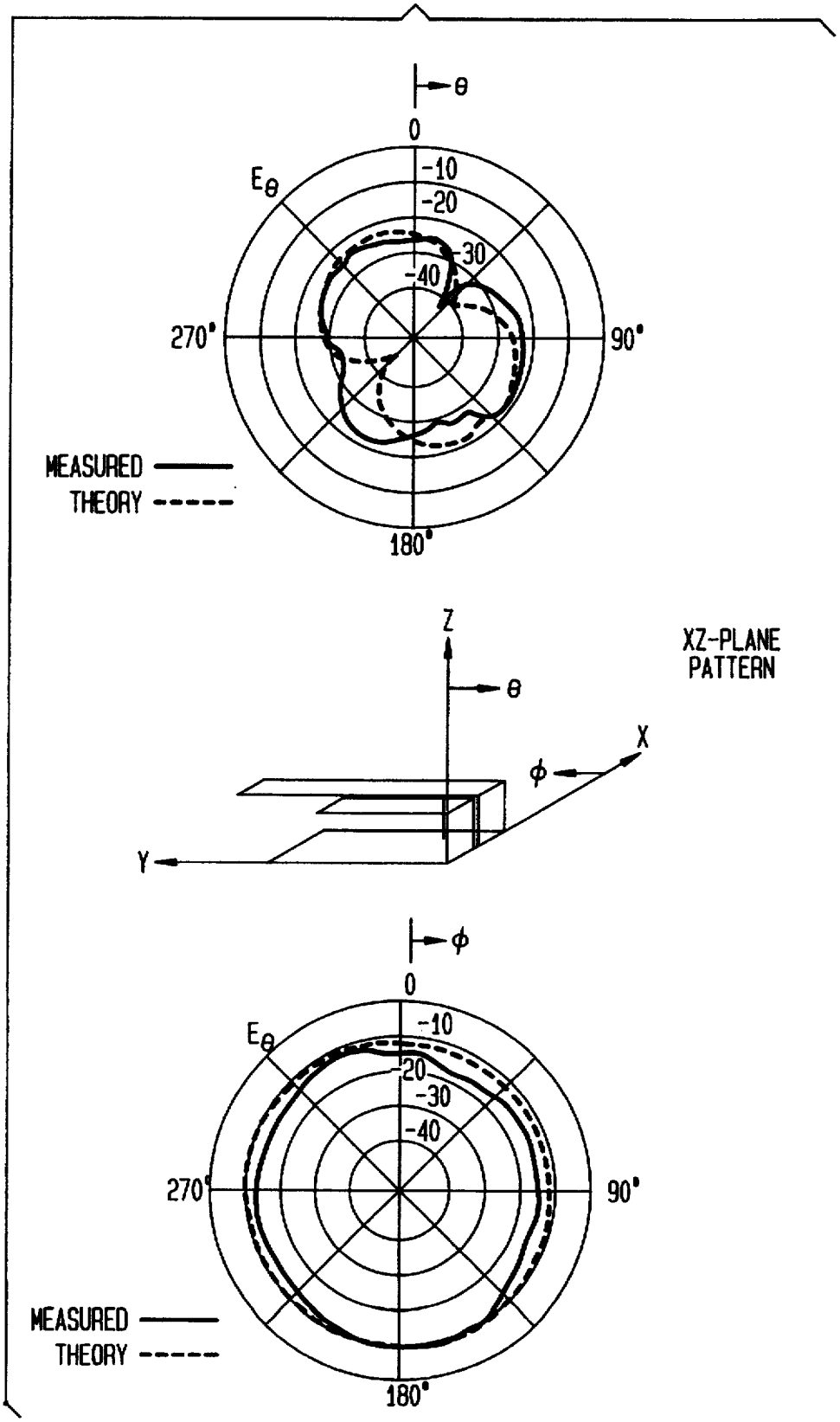
FIG. 4 (PRIOR ART)
FIG. 4 shows an XZ plane field pattern of the antenna of FIG. 1.
Figure 7:
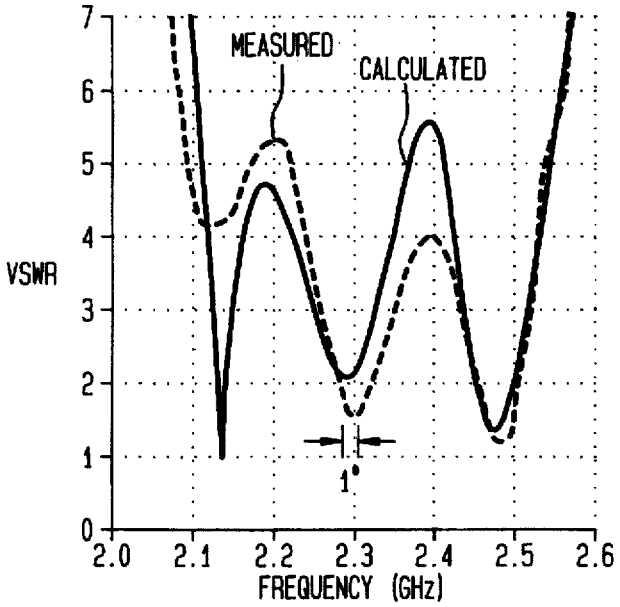
FIG. 7 (PRIOR ART)
FIG. 7 shows the variation of reflection coefficient of the antenna of FIG. 6 with frequency.
Figure 8:
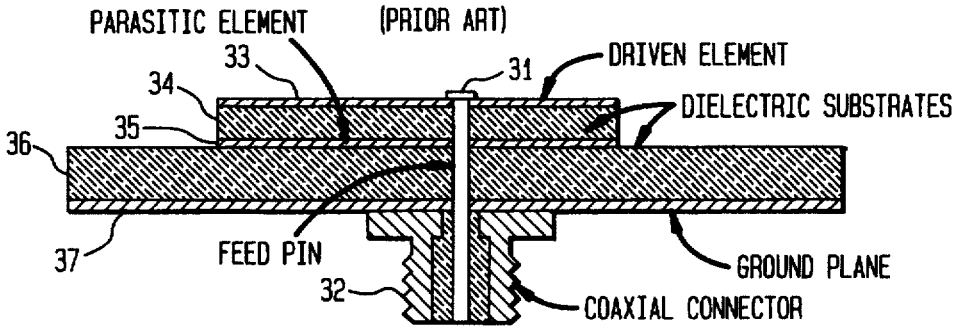
FIG. 8 (PRIOR ART)
FIG. 8 shows a conventional multilayered coupled microstrip patch antenna.
Figure 9:
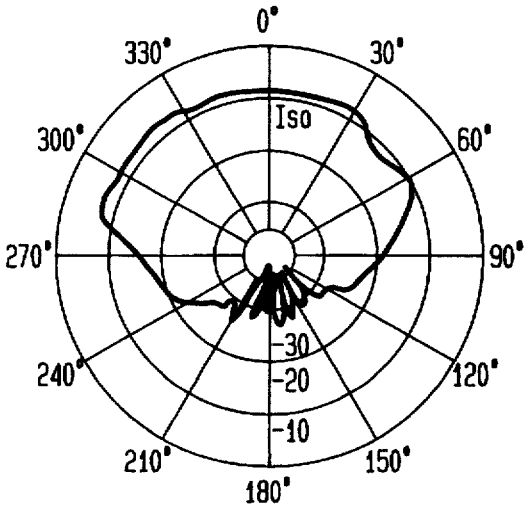
FIG. 9 (PRIOR ART)
FIG. 9 shows a field pattern for the antenna of FIG. 6.
Figure 10:
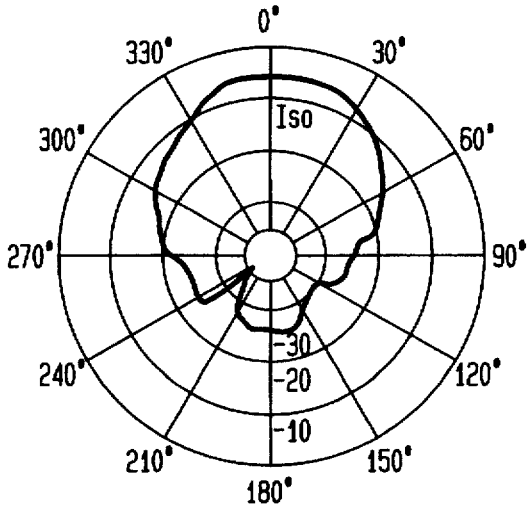
FIG. 10 (PRIOR ART)
FIG. 10 shows a field pattern for the antenna of FIG. 8.
Figure 11:
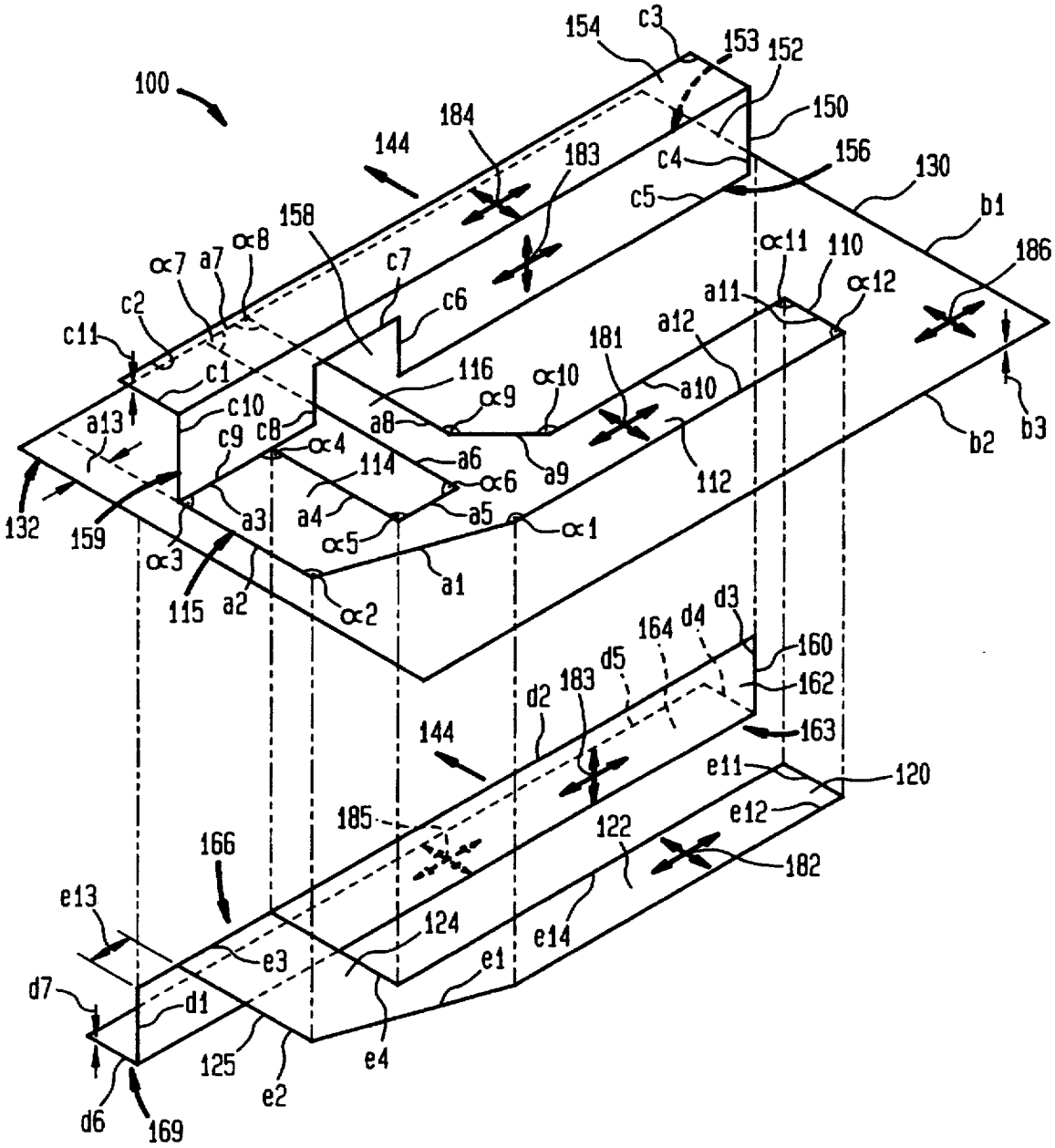
FIG. 11 shows an isometric exploded view of an antenna according to an embodiment of the present invention.

FIG. 11 shows an antenna 100 according to an embodiment of the present invention. The antenna 100 has a first resonant element 110, a second resonant element 120, a dielectric 130 and a metal cover 140. The metal cover 140 provides electromagnetic shielding for the first and second resonant elements 110 and 120. As shown, the metal cover 140 includes two cover portions 150 and 160. The cover portion 150 is connected to the first resonant element 110 and the cover portion 160 is connected to the second resonant element 120.

As shown, the first resonant element 110 has an approximate "F" shape, with long segment 112, upper perpendicular segment 114 and lower perpendicular segment 116. As an example, the dimensions of the segments which make up the first resonant element may be a1=0.64 cm, a2=0.456 cm, a3=0.46 cm, a4=0.46 cm, a5=0.52 cm, a6=1.68 cm, a7=0.20 cm, a8=1.28 cm, a9=0.40 cm, a10=1.01 cm, a11=0.46 cm, a12=1.90 cm, $\alpha1=\alpha2=135°$, $\alpha3=\alpha4=\alpha5=\alpha6=\alpha7=\alpha8=\alpha11=\alpha12=90°$, $\alpha9=60°$ and $\alpha10=30°$. Illustratively, the top edge 115 of the upper segment 114 is located a13=0.2 cm from the edge 132 of the dielectric 130.

The second resonant element 120 has an approximate "L" shape, with long segment 122 and perpendicular short segment 124. Illustratively, the segment 122 underlies the segment 112 and has the same dimensions (e1=a1, e2=a2, e3=a3, e11=a11, e12=a12, e14=a10+a7+a5+a9·cos (180-$\alpha$10)). Likewise, the segment 124 underlies the segment 114 and has the same dimensions. Illustratively, the top edge 125 of the short segment 114 is e13=0.2 cm from the edge 132 of the dielectric 130.

The cover portions 150 and 160 are in the shape of L-brackets. That is, the cover portion 150 includes two surfaces 152 and 154 that are perpendicularly joined at a common edge 153. Likewise, the cover portion 160 includes two surfaces 162 and 164 that are perpendicularly connected at a common edge 163.

The surface 152 of the cover portion 150 is connected to the upper segment 114 of the first resonant element 120 at a connecting edge 156. The surface 152 of the cover portion 150 also has a slot 158 formed therein which provides a passage through which the lower segment 116 of the first resonant element 110 passes. The surface 154 extends from the common edge 153 in a direction 144 opposite to the long segment 112 and upper segment 114 of the first resonant element 110 and the entire second resonant element 120. For sake of illustration, the cover portion 150 may have the following dimensions: c1=0.5 cm, c2=4.5 cm, c3=0.5 cm, c4=0.5 cm, c5=3.1 cm, c6=0.2 cm, c7=0.6 cm, c8=0.2 cm, c9=0.8 cm, c10=0.5 cm and c11=0.001". Illustratively, the edge 159 is a13=0.2 cm from the edge 132 of the dielectric 130.

The surface 162 of the cover portion 160 is connected to the short segment 124 of the second resonant element 120 at a connecting edge 166. The surface 164 extends from the common edge 163 in the direction 144 opposite to the long segment 112 and the upper segment 114 of the first resonant element 110 and the entire second resonant element 120. For sake of illustration, the cover portion 160 may have the following dimensions: d1=0.5 cm, d2=4.8 cm, d3=0.5 cm, d4=0.5 cm, d5=4.8 cm, d6=0.5 cm and d7=0.5 cm. Illustratively, the edge 169 is aligned with the edge 132 of the dielectric 130.

The metal cover 140 prevents signals that are emitted by the first and second resonant elements 110 and 120 from propagating to the opposite side of portions 152, 162 (to which side the conductor 116 extends). Likewise, the metal cover 140 prevents signals which may be emitted by circuitry (such as transceiver circuitry to which the antenna 100 is connected) on the side of the metal cover portions 152, 162 opposite to the first and second resonant elements 110, 120, from propagating to, and being received by, the resonant elements 110 and 120.

Illustratively, the dielectric 130 is simply a portion of a fiberglass printed circuit board substrate, which has at least the following dimensions: b1=2.5 cm, b2=4.9 cm and b3=0.16 cm. In such a case, the first and second resonant elements 110 and 120 may simply be conductors that are laid out on the printed circuit board substrate/dielectric 130. For purposes of illustration, the thickness of such resonant elements may be 36 μm. Illustratively, this may be achieved using well known printed circuit board construction processes. The metal cover 140 may be formed of any usual shielding structure and material for RF modules including copper, aluminum, or metal coated plastics, etc.

As shown, the first resonant element 110 lies in a first plane 181. The second resonant element 120 lies in a second plane 182 that is parallel to the first plane 181. The surfaces 152 and 162 lie in a third plane 183 that is perpendicular to the planes 181 and 182. The surface 154 lies in a fourth plane 184. The surface 164 lies in a fifth plane 185. The dielectric 130 illustratively lies in a sixth plane 186. The planes 184, 185, 186, 181 and 182 are all parallel. Thus, the coupled resonant elements 110 and 120 are non-coplanar; rather they are in different parallel planes.

Figure 12:
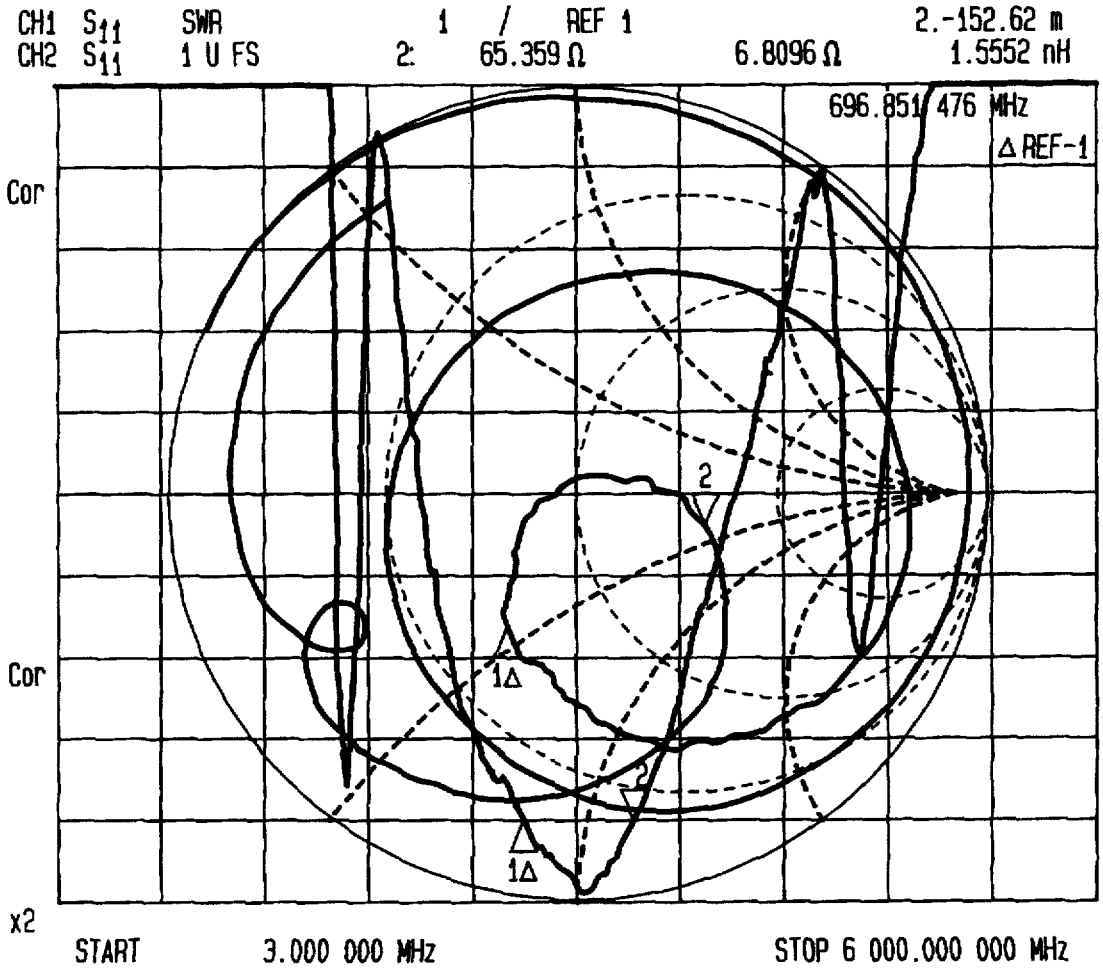
FIG. 12 shows the variation of the reflection coefficient of the antenna of FIG. 11 with frequency.
Figure 13:
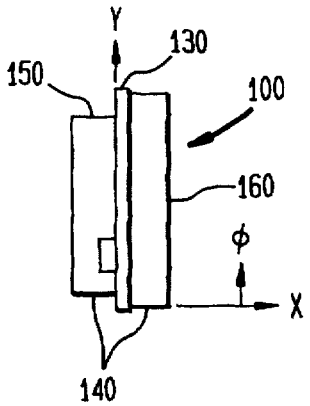
FIGS. 13, 14 and 15 show XY plane, YZ plane and XZ plane elevation views of the antenna of FIG. 11.
Figure 14:
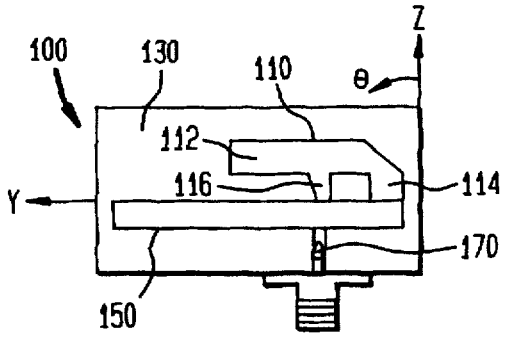
Figure 15:
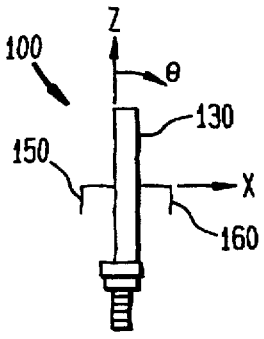
Figure 16:
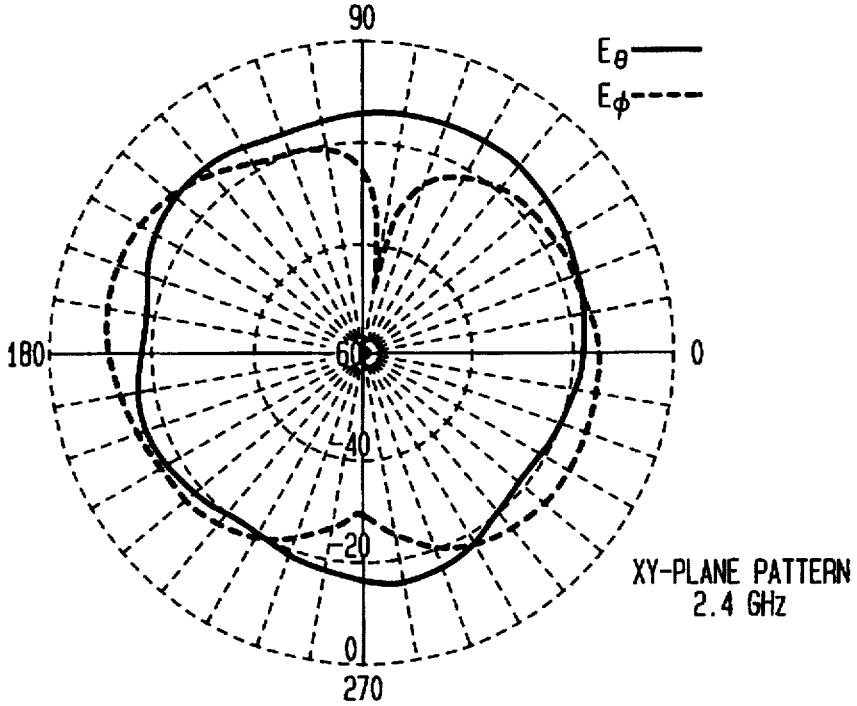
FIGS. 16, 17 and 18 show XY plane, YZ plane and XZ plane field patterns for the elevations shown in FIGS. 13, 14 and 15, respectively.
Figure 17:
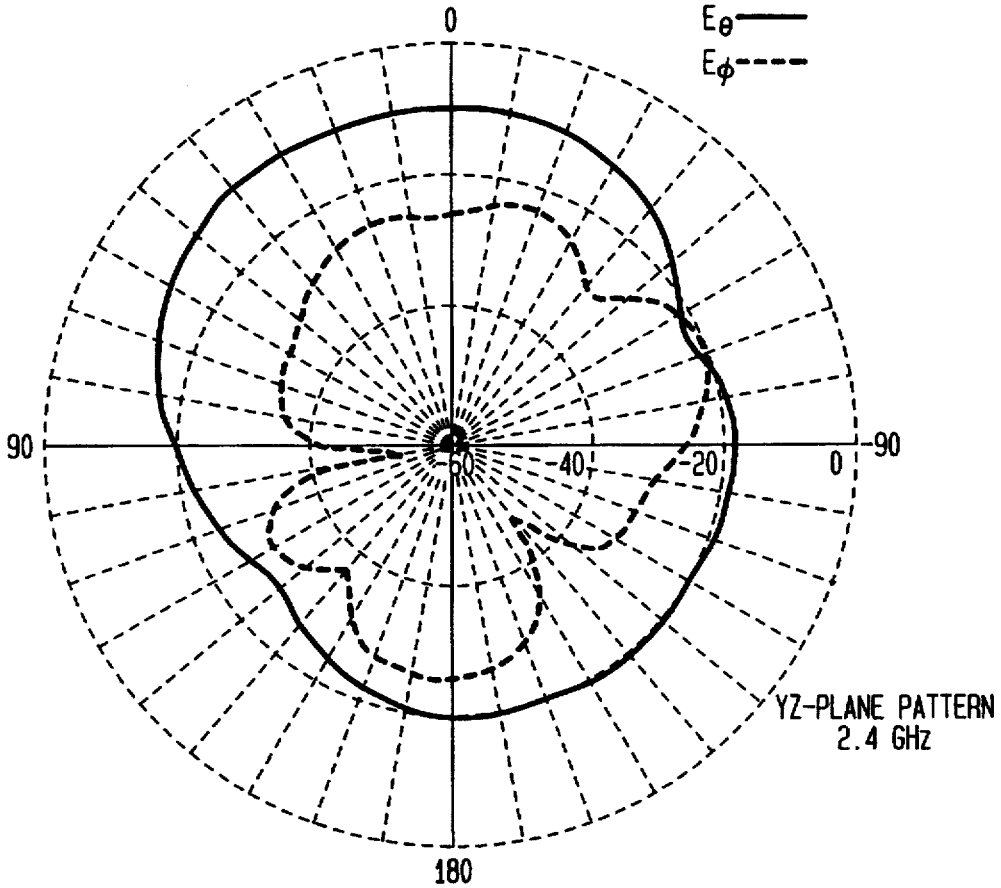
Figure 18:
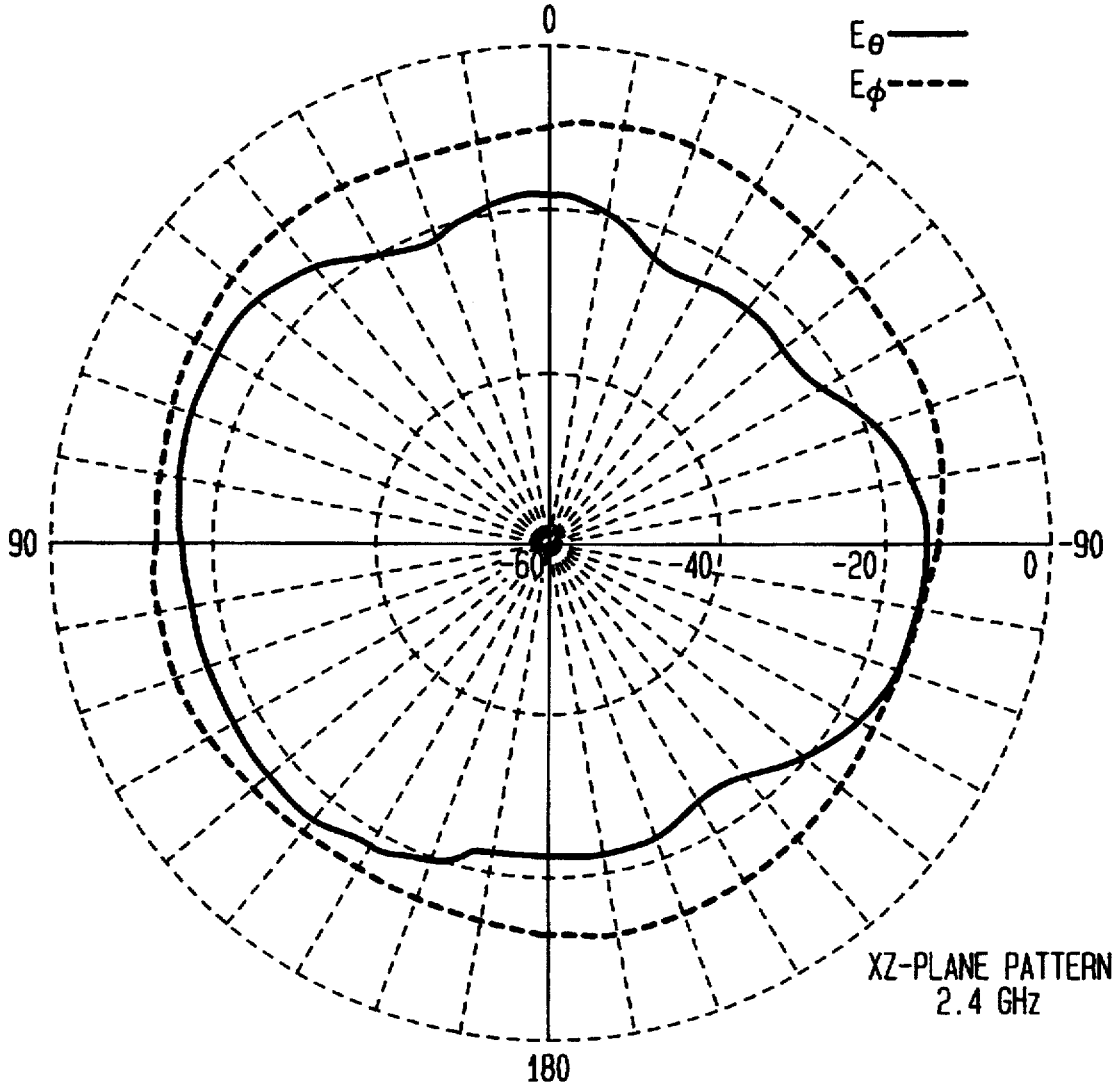

In normal operation, the metal cover 140 is grounded (both parts 150 and 160) A center conductor 170 (FIG. 14)

of an RF connector connected to the lower segment 116 provides an input signal to be radiated by the antenna 100. FIG. 12 illustrates the $S_{11}$ reflection coefficient of an antenna embodiment designed for 2.4 GHz. As shown, the antenna has a bandwidth of about 23%. (For purposes of testing, a 3.9 nH shunt was used on the input port as a matching inductance.) FIGS. 13, 14 and 15 show XY plane, YZ plane and XZ plane elevation views of the antenna 100, respectively. FIGS. 16, 17 and 18 show field patterns for the elevation views shown in FIGS. 13, 14 and 15, respectively. As indicated in FIGS. 16–18, the antenna 100 radiates the signal fairly omni-directionally.

The following table summarizes the differences between the present invention and the prior art.

| | Planar Dual-L | Coupled Microstrip Patch | Present Invention |
|---|---|---|---|
| Area | 2.8 $cm^2$ | 30 $cm^2$ | 2.5 $cm^2$ |
| Height | 5 cm | 1 cm | 1 cm |
| Bandwidth | 25% | 18% | 23% |
| Manufacturing Process | precision metal process | multilayer PCB | multilayer PCB |
| Radiated Field Directionality | omni-directional | directed beam | omni-directional |
| Assembly | manual | manual | automated |
| Shape Flexibility | small | small | large |
| Structural Strength | low | high | high |

Finally, the above discussion is intended to be illustrative of the invention. Those having ordinary skill in the art may devise numerous alternative embodiments without departing from the spirit and scope of the following claims.

I claim:

1. An antenna comprising:

a first strip resonant element having an F-shaped area that lies in a first plane, a second strip resonant element having an L-shaped area that lies in a second plane that is parallel to said first plane, said second strip resonant element at least partially underlying said first strip resonant element, a dielectric positioned between said first and second strip resonant elements, and a metal cover, a part of which is perpendicular to said first and second strip resonant elements so as to provide electromagnetic shielding for said first and second strip resonant elements.

2. The antenna of claim 1 wherein said first and second strip resonant elements are conductors of a printed circuit board and wherein said dielectric is a printed circuit board substrate on which said first and second strip resonant elements are laid out.

3. The antenna of claim 1 wherein said metal cover is connected to ground.

4. An antenna comprising:

a first strip resonant element having an F-shaped area that lies in a first plane, a second strip resonant element having an L-shaped area that lies in a second plane that is parallel to said first plane, said second strip resonant element at least partially underlying said first strip resonant element, a dielectric positioned between said first and second strip resonant elements, and a metal cover, a part of which is perpendicular to said first and second strip resonant elements so as to provide electromagnetic shielding for said first and second strip resonant elements, wherein said metal cover comprises first and second L-bracket shaped portions, said first L-bracket shaped portion being perpendicularly connected to said first strip resonant element and said second L-bracket shaped portion being perpendicularly connected to said second strip resonant element so that said first and second L-bracket shaped portions overlap each other but do not overlap said second strip resonant element.

5. The antenna of claim 2 wherein each of said first and second L-bracket shaped portions comprises two planar surfaces which are perpendicularly connected together at a common edge of both of said surfaces, said first strip resonant element being connected to an edge, parallel to said common edge, of said first L-bracket shaped portion and said second strip resonant element being connected to an edge, parallel to said common edge, of said second L-bracket shaped portion, said connecting edges and common edges of said first and second L-bracket shaped portions lying in the same plane which is perpendicular to both said first and second planes.

6. The antenna of claim 4 wherein said first and second strip resonant elements are conductors of a printed circuit board and wherein said dielectric is a printed circuit board substrate on which said first and second strip resonant elements are laid out.

7. The antenna of claim 4 wherein said perpendicular part of said metal cover comprises a slot, and wherein a portion of said first strip resonant element extends through said slot.

8. The antenna of claim 7 wherein said portion of said first strip resonant element which extends through said slot is connected to a conductor which carries a signal to be radiated by said antenna.

9. The antenna of claim 8 wherein said metal cover is connected to ground.

10. An antenna comprising:

a first strip resonant element having an F-shaped area that lies in a first plane, a second strip resonant element having an L-shaped area that lies in a second plane that is parallel to said first plane, said second strip resonant element at least partially underlying said first strip resonant element, a dielectric positioned between said first and second strip resonant elements, and a metal cover, a part of which is perpendicular to said first and second strip resonant elements so as to provide electromagnetic shielding for said first and second strip resonant elements, wherein said perpendicular part of said metal cover comprises a slot, and wherein a portion of said first strip resonant element extends through said slot.

11. The antenna of claim 10 wherein said portion of said first strip resonant element which extends through said slot is connected to a conductor which carries a signal to be radiated by said antenna.

12. The antenna of claim 11 wherein said metal cover is connected to ground.

13. The antenna of claim 7 wherein said first and second strip resonant elements are conductors of a printed circuit board and wherein said dielectric is a printed circuit board substrate on which said first and second strip resonant elements are laid out.

* * * * *